US006945419B2

(12) United States Patent
Bertazza et al.

(10) Patent No.: US 6,945,419 B2
(45) Date of Patent: Sep. 20, 2005

(54) CONTAINER FOR COSMETIC PRODUCTS

(75) Inventors: Luciano Bertazza, Villa d'Alme' (IT); Elio Davoli, Reggio Emilia (ET)

(73) Assignee: F.F. Consult S.r.l., Reggio Emilia (IT)

( * ) Notice: Subject to any disclaimer, the term of this patent is extended or adjusted under 35 U.S.C. 154(b) by 75 days.

(21) Appl. No.: 10/258,137

(22) PCT Filed: Mar. 20, 2001

(86) PCT No.: PCT/IT01/00138

§ 371 (c)(1),
(2), (4) Date: Oct. 21, 2002

(87) PCT Pub. No.: WO01/78551

PCT Pub. Date: Oct. 25, 2001

(65) Prior Publication Data

US 2003/0075199 A1 Apr. 24, 2003

(30) Foreign Application Priority Data

Apr. 19, 2000 (IT) ..... RE2000A0032

(51) Int. Cl.[7] ..... B65D 21/02

(52) U.S. Cl. ..... 220/23.87; 220/23.89; 220/23.91

(58) Field of Search ..... 220/23.87, 23.89, 220/23.91, 359.1, 359.2; 132/218; 215/232

(56) References Cited

U.S. PATENT DOCUMENTS

| | | | | | |
|---|---|---|---|---|---|
| 4,705,053 | A | * | 11/1987 | Goncalves | 132/218 |
| 5,372,268 | A | * | 12/1994 | Han | 215/232 |
| 5,611,687 | A | | 3/1997 | Wagner | |
| 6,026,825 | A | * | 2/2000 | de Laforcade | 132/218 |

FOREIGN PATENT DOCUMENTS

| | | | |
|---|---|---|---|
| EP | 0 468 265 | | 1/1992 |
| ES | 2 113 773 | | 5/1998 |
| FR | 2 682 019 | | 4/1993 |
| JP | 1221105 A | * | 9/1989 |
| JP | 9103322 A | * | 4/1997 |

* cited by examiner

*Primary Examiner*—Stephen Castellano
(74) *Attorney, Agent, or Firm*—Young & Thompson

(57) ABSTRACT

A container (9) for cosmetic products in general constituted by an extractable cartridge (1), by an outer body (3), and by a cap (5) includes removable locking elements (8) provided between the cartridge and the outer body.

7 Claims, 3 Drawing Sheets

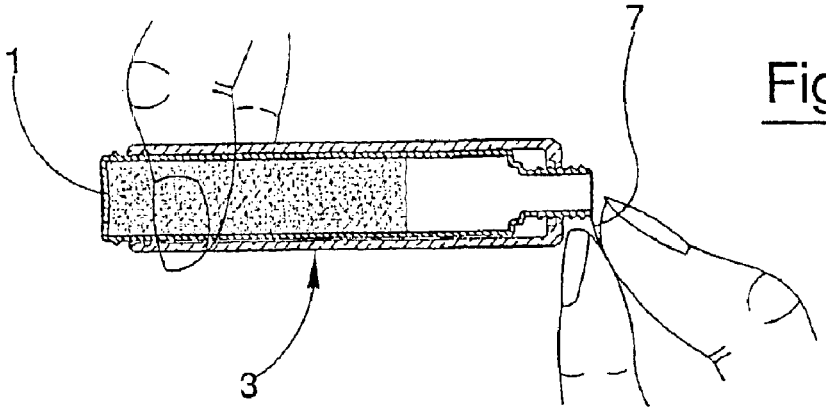
Fig. 7
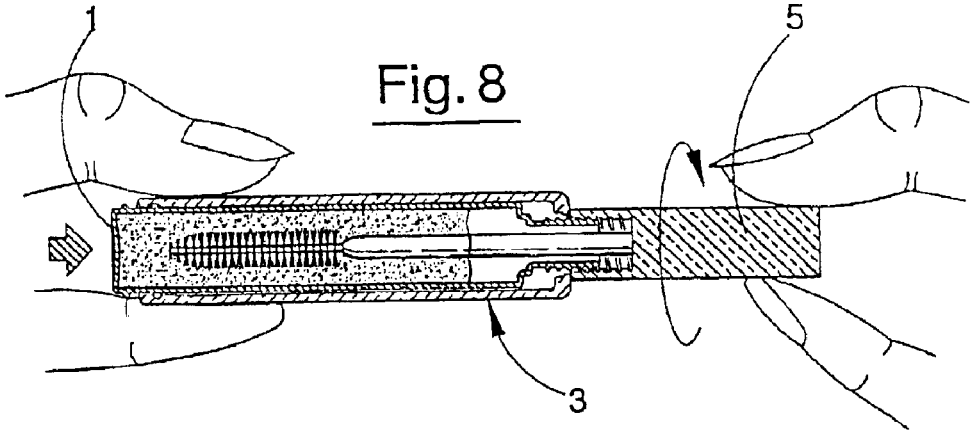
Fig. 8
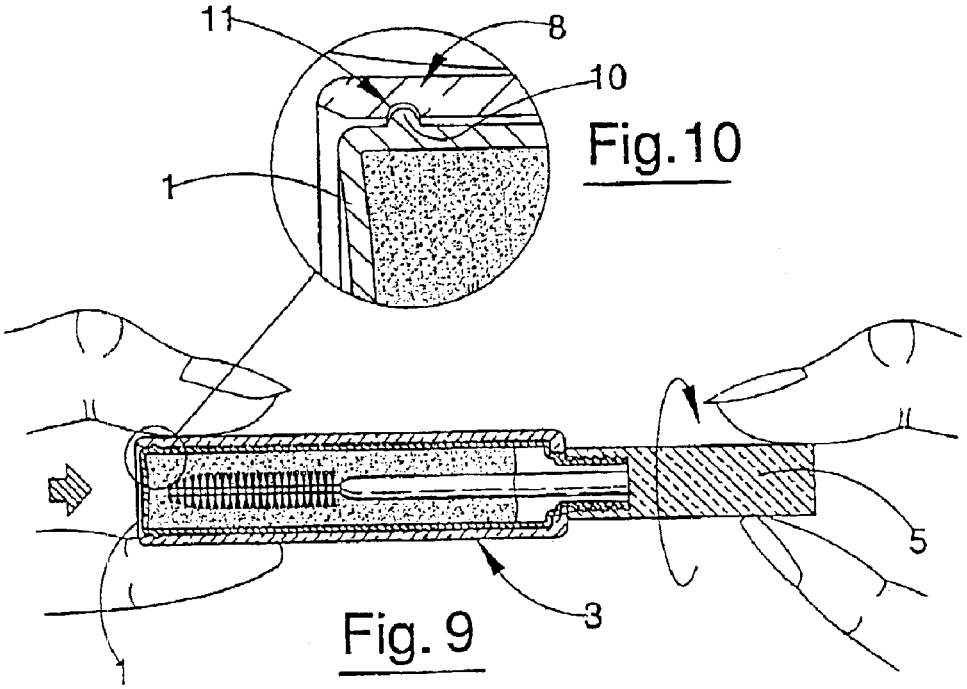
Fig. 10
Fig. 9

CONTAINER FOR COSMETIC PRODUCTS

CROSS REFERENCE TO RELATED APPLICATION

This is the 35 USC 371 national stage of International Application PCT/IO01/00138 filed on 20 Mar. 2001, which designated the United States of America.

TECHNICAL FIELD

The present invention relates to a container for cosmetic products in general, and more in particular for those liquid or paste products, with high moisture content, such as the so/called "mascara" or any lacquer for emphasising eyelashes or eyebrows; or also any lotion for cosmetic or even medical use, to be applied on parts of the body by means of a tool such as a small brush.

BACKGROUND ART

It is known that currently such products are packaged in a predetermined weight in containers which may be more or less important in terms of shape complexity and of the materials whereof they are made, such containers being mostly closed by the simple screwing of a cap.

Such known containers are generally filled, in a non standardised manner and not contiguously to their product, also using barrels of larger or smaller size supplied to third parties who then provide for retail packaging to the public.

These production and distribution systems entail several drawbacks.

A first drawback is connected to possible manipulation of the product during the filling of individual containers, there being the possibility of various kinds of pollution (for instance bacteriological), due not only to manipulation during production, but also to the distribution carried out in small containers which are closed but not sealed or in large containers which presuppose storage and transfers with high risk of contamination.

In other words, since the container of the product is not sealed, enriched as it may be by materials, shapes, and even prestigious marks, the possibility nonetheless exists that the container could fail to meet the criteria of hygienic safety and commercial correctness required by the final consumer.

A consequence of this way of packaging known containers is constituted by the uncertain possibility of tracing the production lot (date, origin, etc.).

There are also environmental drawbacks connected to the disposal of the containers once their content is exhausted.

Once the product contained is exhausted, the whole container with any small tools contained therein (for instance brushes, scrapers, small sponges for applying the products, etc.) is thrown away, thus creating an environmental damage and a waste.

SUMMARY OF THE INVENTION

The aim of the present invention is to overcome the aforesaid drawbacks, providing a container for cosmetic or medical products in general which is completely recyclable, and allows on one hand an absolute guarantee on the integrity of the content, and on the other hand quality control over the entire history of the lot wherefrom the product comes.

Said aims are fully achieved by the container for cosmetic product of the present invention, which is characterised by the contents of the claims set out below and in particular in that it comprises a recyclable and sealable cartridge, provided with means for locking to an outer body able to be disengaged axially by applying a simple thrust.

DESCRIPTION OF THE DRAWINGS

This and other features shall become more readily apparent from the description that follows of a preferred embodiment illustrated, purely by way of non limiting example, in the accompanying drawing tables, in which:

FIG. 7 shows the extraction of the seal from the cartridge;

FIG. 8 and FIG. 9 show the procedure for the definitive introduction and setting of the cartridge in the outer body, with the related positioning of the applying brush and of the closure cap;

FIG. 10 shows a detail of the disengageable locking means between cartridge and outer body.

DESCRIPTION OF THE ILLUSTRATIVE EMBODIMENT

Figure 1:
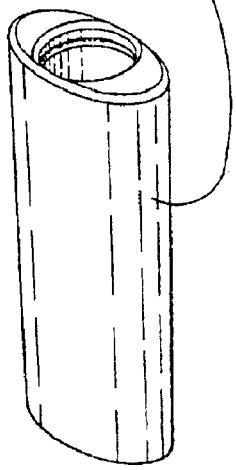
FIG. 1 shows a view of the outer body.

With reference to the aforesaid figures, the reference number 1 indicates a cartridge made of plastic material, specifically of polyethylene for food products, constituted by an elongated cylindrical body provided with a threaded mouth 2; the reference number 3 indicates a hollow outer body wherein the cartridge 1 can be inserted, and locked in a disengageable manner by means of the interference of locking means 8 constituted by the elastic interference of an annular edge 10 with a related recess 11, the edge and the corresponding recess 11 being obtained on opposite parts of the cartridge 1 and of the body 3.

The reference 4 indicates a known brush for applying the product, the reference 5 indicates a general closure cap with related threaded seat 6 which is destined to cooperate with the thread 2 of the cartridge 1.

The reference number 7 indicates an adhering film, heat sealed to the threaded mouth 2 of the cartridge 1, serving as a seal removable by tearing.

The reference number 8 indicates locking means between the cartridge 1 and the body 3, disengageable by the simple application of an axial thrust; said locking, means are constituted by a projecting edge 10 which interferes elastically on a corresponding groove 11, such means being obtained respectively on the cartridge 1 and on the body 3.

In a possible variation, such means can be obtained in an inverted manner, i.e. respectively the projecting edge on the body 3 and the groove on the cartridge 1.

The operation is as follows.

Figure 2:
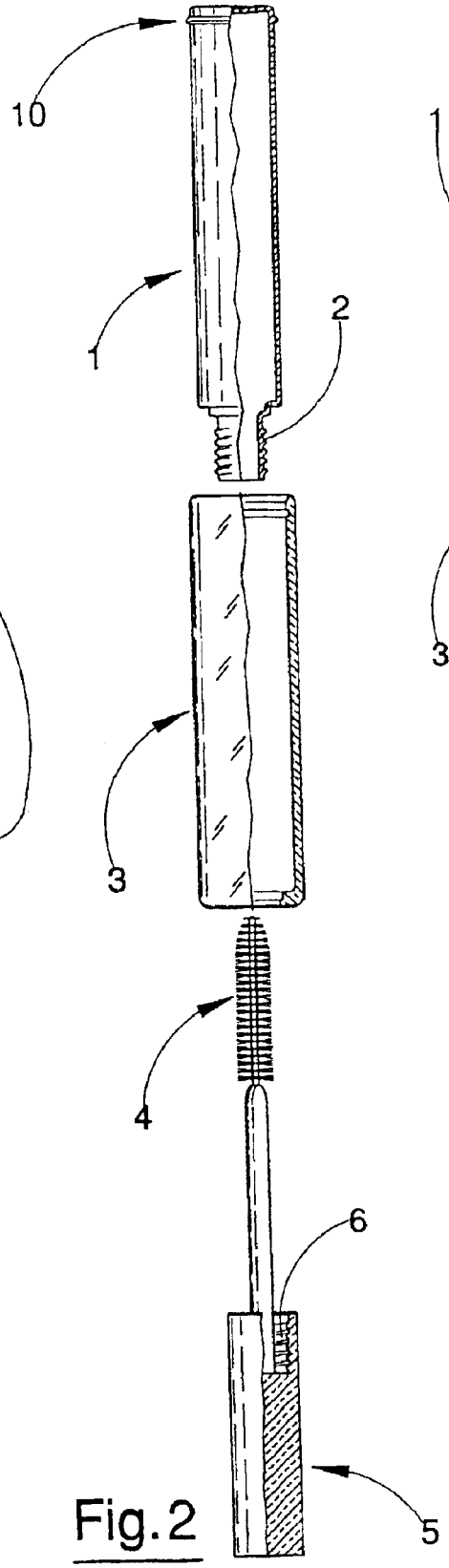
FIG. 2 shows an "exploded" view of the invention, which comprises three elements: refill cartridge, outer body, cap connected to the brush for applying the product.
Figure 3:
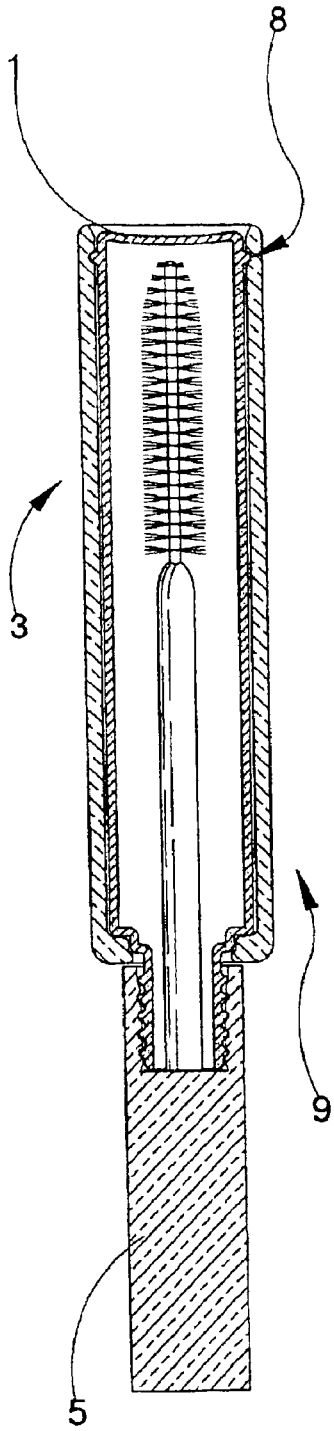
FIG. 3 shows a view of the invention in its complete structure, perfectly closed.

The container is shown in its elementary components in FIGS. 1 and 2, whereas FIG. 3 shows the container assembled and ready for use.

Figure 4:
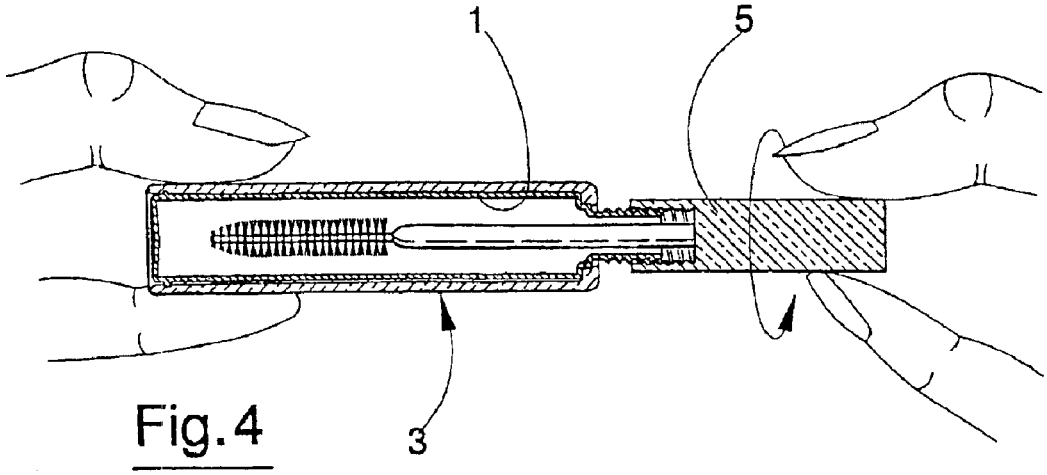
FIG. 4 and FIG. 5 show the procedures for extracting the exhausted cartridge from the invention.
Figure 5:
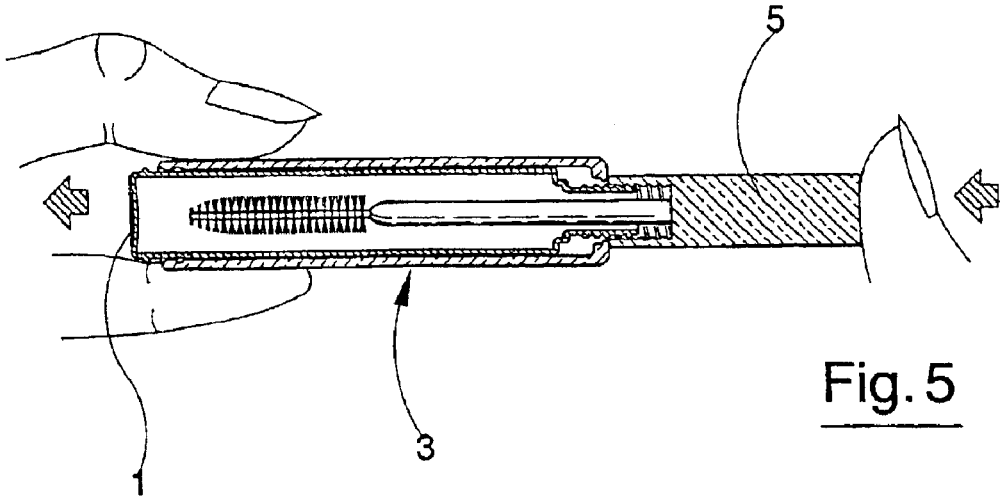

Once the product is exhausted, the cartridge 1 is replaced through the partial counter-clockwise unscrewing of the cap (see FIG. 4) with the consequent partial extraction of the panel; a pressure is then exerted on the cap (see FIG. 5) until the cartridge is unlocked from the outer body and the cartridge is fully extracted after completely unscrewing the cap from the package.

Figure 6:
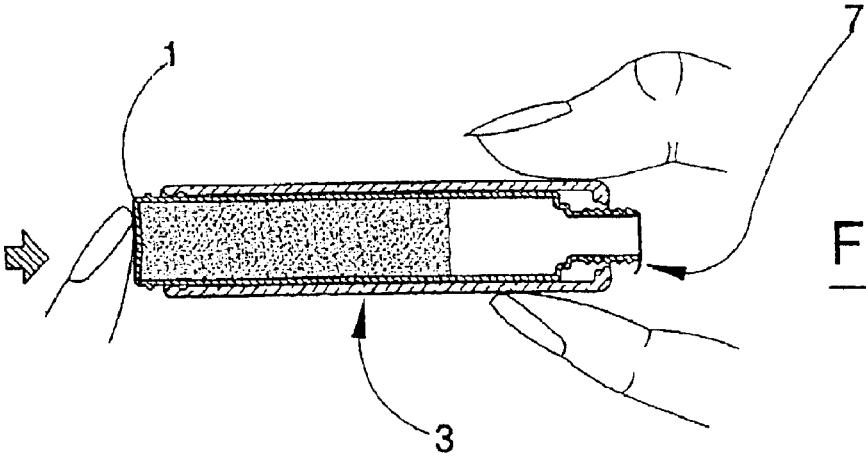
FIG. 6 shows the procedure for inserting the new cartridge, virgin and sealed.

Subsequently, as shown in FIG. 6, a new virgin cartridge is partially introduced in the outer body, the heat-sealed sealing film 7 is removed (see FIG. 7) and by the clockwise screwing of the cap/brush the cartridge is driven all the way into the interior of the body, until the slight projection 10 of the cartridge matches and snaps into the corresponding recess 11 of the body.

FIG. 9 shows the final outcome of this introductory operation which is made easy by the particular conformation of the screw that has a thread with asymmetrically shaped teeth, so that considerable force can be exerted during the screwing operation.

The cartridge 1 is manufactured with polyethylene for food products; for its fabrication, known injection and blowing techniques are used.

The testing conducted allows to state that the invention, thanks to its basic components made of sterilisable polyethylene offers, from the hygienic and health standpoint, more guarantees than products that use conventional materials.

The invention has several advantages.

First of all, the cartridge 1 made with polyethylene for food products allows, unlike most PVCs or other materials, to be subjected to a sterilisation treatment with gamma rays during the phase preceding the filling operation.

Once the filling operation is complete, the cartridge is heat sealed with a film 7 which guarantees that the product will be protected from oxidising agents, thus preserving its genuineness longer.

The consumer will thereby have a guarantee of product conformity, with the related hygienic and health protection.

The particular configuration of the product, constituted by a hollow packaging or outer body 3 that is completely separate from the internal cartridge, allows, once the content of the cartridge is exhausted, to recover or recycle the cartridge, preserving the outer body 3 for a subsequent re-use with a new replacement cartridge 1.

Moreover, the particular conformation of the cartridge allows noticeable savings on transportation and storage costs, savings on primary packaging, and considerable improvements to the automation and product standardisation process.

What is claimed is:

1. A container for cosmetic, or medical product, comprising:

a hollow outer body extending in a direction of a longitudinal axis from an open first end to an opposite open second end;

a cartridge comprising an elongated body provided with a mouth, which is closed with a seal that can be broken at the time of use; said cartridge structured and arranged to be inserted into said outer body such that the mouth extends through one of the open ends of the outer body;

locking means comprising an elastic interference between a projecting edge and a corresponding recess for locking the cartridge to the outer body by application of an axial thrust in the direction of the longitudinal axis; and a closure cap structured and arranged to close the mouth of the cartridge after the seal has been broken.

2. The container according to claim 1, wherein the cartridge is made of polyethylene and is refillable.

3. The container according to claim 1, wherein the mouth of the cartridge is threaded, and the closure cap has a thread for cooperating with the threaded mouth of the cartridge.

4. The container according to claim 1, wherein the projecting edge and the corresponding recess are on opposite parts of the cartridge and outer body.

5. The container according to claim 4, wherein the projecting edge is on an outer wall of the cartridge, and the corresponding recess is on an inner wall of the outer body.

6. The container according to claim 4, wherein the projecting edge is on an inner wall of the outer body, and the corresponding recess is on an outer wall of the cartridge.

7. The container according to claim 1, wherein the closure cap comprises a brush for applying the product.

* * * * *